US010155607B2

(12) United States Patent
Danforth

(10) Patent No.: US 10,155,607 B2
(45) Date of Patent: Dec. 18, 2018

(54) CARRYING APPARATUS WITH INTERNAL SUSPENSION

(71) Applicant: Foreshore Tram & Moorage Ltd., Kelowna (CA)

(72) Inventor: Wayne Danforth, Kelowna (CA)

( * ) Notice: Subject to any disclaimer, the term of this patent is extended or adjusted under 35 U.S.C. 154(b) by 0 days.

(21) Appl. No.: 15/806,299

(22) Filed: Nov. 7, 2017

(65) Prior Publication Data

US 2018/0141717 A1 May 24, 2018

Related U.S. Application Data

(63) Continuation-in-part of application No. 15/356,917, filed on Nov. 21, 2016.

(51) Int. Cl.

| | |
|---|---|
| ***A45F 5/00*** | (2006.01) |
| ***B65D 25/18*** | (2006.01) |
| ***B65D 25/10*** | (2006.01) |
| ***B65D 25/20*** | (2006.01) |
| ***A45F 3/10*** | (2006.01) |
| ***B65D 69/00*** | (2006.01) |
| ***B65D 1/02*** | (2006.01) |
| *A45F 3/14* | (2006.01) |
| *A45F 5/02* | (2006.01) |

(52) U.S. Cl.

CPC ..... *B65D 25/20* (2013.01); *A45F 3/10* (2013.01); *B65D 1/02* (2013.01); *B65D 69/00* (2013.01); *A45F 5/021* (2013.01); *A45F 2003/146* (2013.01); *A45F 2200/0566* (2013.01); *B65D 25/101* (2013.01); *B65D 25/18* (2013.01)

(58) Field of Classification Search

CPC ... A45F 5/021; A45F 2003/144; B65D 25/10; B65D 25/18; B65D 25/101

USPC ..... 224/195, 251, 150; 206/316.2, 594, 592

See application file for complete search history.

(56) References Cited

U.S. PATENT DOCUMENTS

| | | | | |
|---|---|---|---|---|
| 162,055 A | | 4/1875 | Goss | |
| 775,149 A | * | 11/1904 | Righton | A45F 5/02 224/195 |
| 833,911 A | | 10/1906 | Bate | |
| 1,589,315 A | | 6/1926 | Johnston | |
| 1,601,624 A | * | 9/1926 | Houghton | A45F 5/00 224/195 |
| 1,642,046 A | * | 9/1927 | Sauer | A41F 9/002 112/417 |
| 1,968,767 A | | 7/1934 | Howard | |
| 2,496,748 A | | 6/1947 | Pond | |
| 3,004,519 A | | 10/1961 | Weissman | |
| 3,006,645 A | | 10/1961 | Frazier | |
| 3,072,166 A | | 1/1963 | Von Buchholtz et al. | |
| 3,721,216 A | | 3/1973 | Lippe et al. | |
| 3,726,616 A | | 4/1973 | Powers | |
| 3,743,147 A | | 7/1973 | Wilczynski | |

(Continued)

FOREIGN PATENT DOCUMENTS

| | | |
|---|---|---|
| CA | 1108096 | 9/1981 |
| FR | 2447694 | 2/1979 |
| WO | 2005107512 | 11/2005 |

*Primary Examiner* — Justin Larson

(74) *Attorney, Agent, or Firm* — Richard D. Okimaw

(57) ABSTRACT

An apparatus for carrying articles comprising an outer shell extending between top and bottom ends, an attachment for securing the outer shell to a support; and an inner sleeve extending between the top and bottom ends of the outer shell.

11 Claims, 6 Drawing Sheets

(56) References Cited

U.S. PATENT DOCUMENTS 3,868,786 A * 3/1975 Lippe ..... A01K 27/001 446/28
3,910,470 A 10/1975 Swenson et al.
4,177,894 A 12/1979 Petersen
D260,574 S * 9/1981 Outcalt ..... D3/263
4,330,073 A 5/1982 Clark
4,383,565 A 5/1983 Denmat
4,433,803 A * 2/1984 Liberboim ..... A63B 47/001 224/251
4,620,579 A * 11/1986 Lowe ..... A45C 3/00 190/110
4,681,225 A 6/1987 Schuster
4,704,001 A 11/1987 Parandes
5,316,146 A * 5/1994 Graff ..... B01L 9/06 206/438
5,356,004 A 10/1994 Weinreb
5,372,786 A * 12/1994 Iles ..... B01L 9/06 206/562
5,373,980 A 12/1994 Rowell et al.
5,407,640 A * 4/1995 Iles ..... B01L 9/06 206/562
5,570,780 A 11/1996 Miller
5,687,874 A 11/1997 Omori et al.
5,722,576 A 3/1998 Rogers
5,791,481 A * 8/1998 Thomas ..... B65D 25/04 206/581
5,881,933 A * 3/1999 Rogers ..... A41F 9/02 224/195
5,941,438 A * 8/1999 Price ..... A41F 9/002 224/660
5,985,219 A * 11/1999 Lind ..... B01L 9/06 422/562
6,305,537 B1 * 10/2001 Jaffe ..... A45C 11/38 206/316.2
7,100,810 B1 * 9/2006 Bosch ..... F42B 39/02 224/196
7,353,952 B2 * 4/2008 Swartz ..... A45C 11/20 206/545
7,467,729 B2 * 12/2008 Lown ..... B65D 23/08 206/427
7,559,445 B1 * 7/2009 Kulp ..... A45F 3/14 224/627
7,762,440 B2 * 7/2010 Cook ..... F41C 33/046 2/338
7,950,554 B2 * 5/2011 Hoffner ..... A45F 5/02 224/222
8,011,545 B2 * 9/2011 Murdoch ..... A45F 5/02 224/672
8,029,199 B1 10/2011 Kimball
8,281,923 B2 10/2012 Elenes
8,424,680 B2 4/2013 Fair et al.
8,510,868 B2 * 8/2013 Mongan ..... F41C 33/046 2/300
8,662,368 B2 * 3/2014 Elliott ..... A45C 11/38 224/236
8,985,411 B2 * 3/2015 Mongan ..... A45F 5/021 224/195
9,629,398 B2 * 4/2017 Goryl ..... A41D 13/0012
9,861,851 B1 * 1/2018 Owens ..... A63B 21/065
2002/0096545 A1 7/2002 Chang
2003/0110550 A1 * 6/2003 Guibord ..... A41F 9/002 2/312
2004/0226972 A1 * 11/2004 Cook ..... A45F 5/021 224/195
2005/0248913 A1 * 11/2005 Hassett ..... G06F 1/1628 361/679.55
2006/0283737 A1 * 12/2006 Hassett ..... A45C 11/38 206/316.2
2007/0187443 A1 * 8/2007 Swartz ..... A45F 5/02 224/148.4
2009/0302076 A1 12/2009 Romano et al.
2011/0240705 A1 10/2011 Landano
2012/0055822 A1 3/2012 Bullock
2016/0051037 A1 2/2016 Ballard

* cited by examiner

CARRYING APPARATUS WITH INTERNAL SUSPENSION

CROSS-REFERENCE TO RELATED APPLICATION(S)

The present application is a continuation in part of, and is related to and claims priority to, pending U.S. Non-Provisional patent application Ser. No. 15/356,917, filed Nov. 21, 2016, entitled "Slip Belt Carrying Apparatus", which is incorporated by reference herein in its entirety.

BACKGROUND OF THE INVENTION

1. Field of Invention

The present invention relates generally to an apparatus for carrying articles, and in particular to a container with a protective suspension system therein.

2. Description of Related Art

In a variety of employment and hobby activities, it is desirable to have a number of objects close at hand and carried on the user for ready access. Examples of such activities include tradesmen carrying tools, police or military personnel carrying weapons and ammunition, safety personnel carrying first aid and triage equipment, and photographers carrying camera equipment and accessories.

Some objects to be carried close at hand are fragile or sensitive to impact and can be easily damaged, such as camera equipment and accessories. When carrying these items, extra care is required. Disadvantageously, even though the user is aware that extra care is required, circumstances may result in damage to the objects. Containers with internal padding have been developed to reduce damage to the contents within. Examples of containers with internal padding include U.S. Pat. No. 4,177,894 (Petersen), U.S. Pat. No. 4,330,073 (Clark) and U.S. Pat. No. 4,383,565 (Denmat). Disadvantageously, the padding is ideally sized and shaped to specific objects, resulting in the need for a variety of containers to house a variety of objects. It can be costly to purchase containers which are limited in use.

SUMMARY OF THE INVENTION

According to a first embodiment of the present invention there is disclosed an apparatus for carrying articles comprising an outer shell extending between top and bottom ends, an attachment for securing the outer shell to a support; and an inner sleeve extending between the top and bottom ends of the outer shell.

The outer shell may have an essentially rounded square tubular shape. The attachment may comprise a selectably securable clip.

The inner sleeve may comprise an elastic tubular member sized with a smaller diameter than the outer shell and stretched at the top and bottom ends to form an hourglass shape inside the outer shell. The elastic tubular member may have a length extending beyond the top and bottom ends of the outer shell. The elastic tubular member may be folded over the top and bottom ends of the outer shell to enclose the top and bottom ends of the outer shell. The elastic tubular member may be secured to the outer shell at the top and bottom ends of the outer shell with an attachment method selected from a group consisting of sewing and adhesive. The elastic tubular member may be secured to the outer shell at the top and bottom ends of the outer shell with edge trim moldings. The elastic tubular member may have a length less than the outer shell and may be stretched to extend between the top and bottom ends of the outer shell so as to be narrowed at a middle portion thereof. The elastic tubular member may be fabricated using neoprene material with Lycra nylon laminated thereon.

The apparatus of may further comprise at least one lid. The at least one lid may be selectably securable to the top or bottom end of the outer shell. The at least one lid may be secured to the bottom end of the outer shell.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
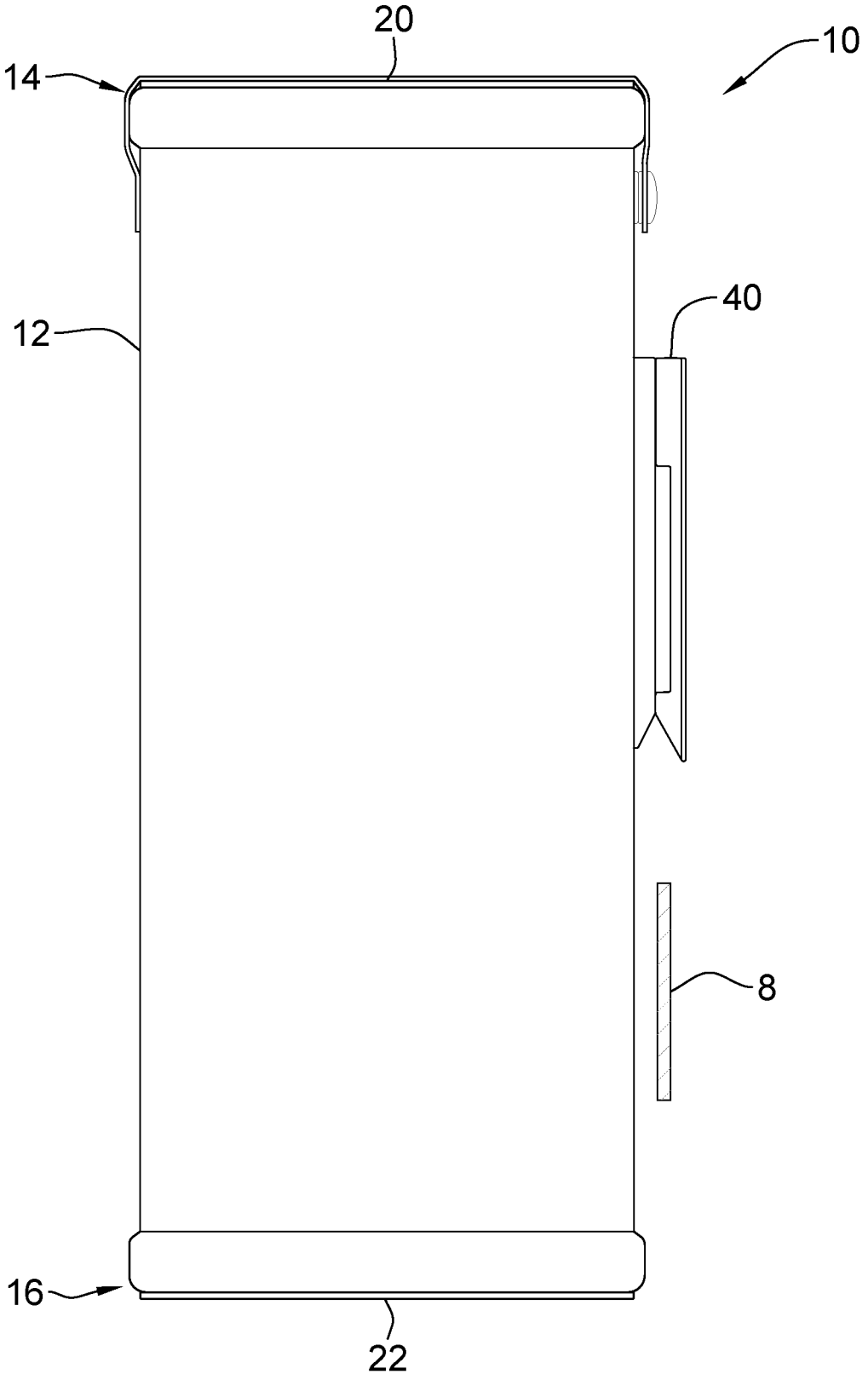
FIG. 1 is a side view of a container for carrying articles according to a first embodiment of the invention with a cross-sectional view of a belt onto which the container may be mounted.
Figure 3:
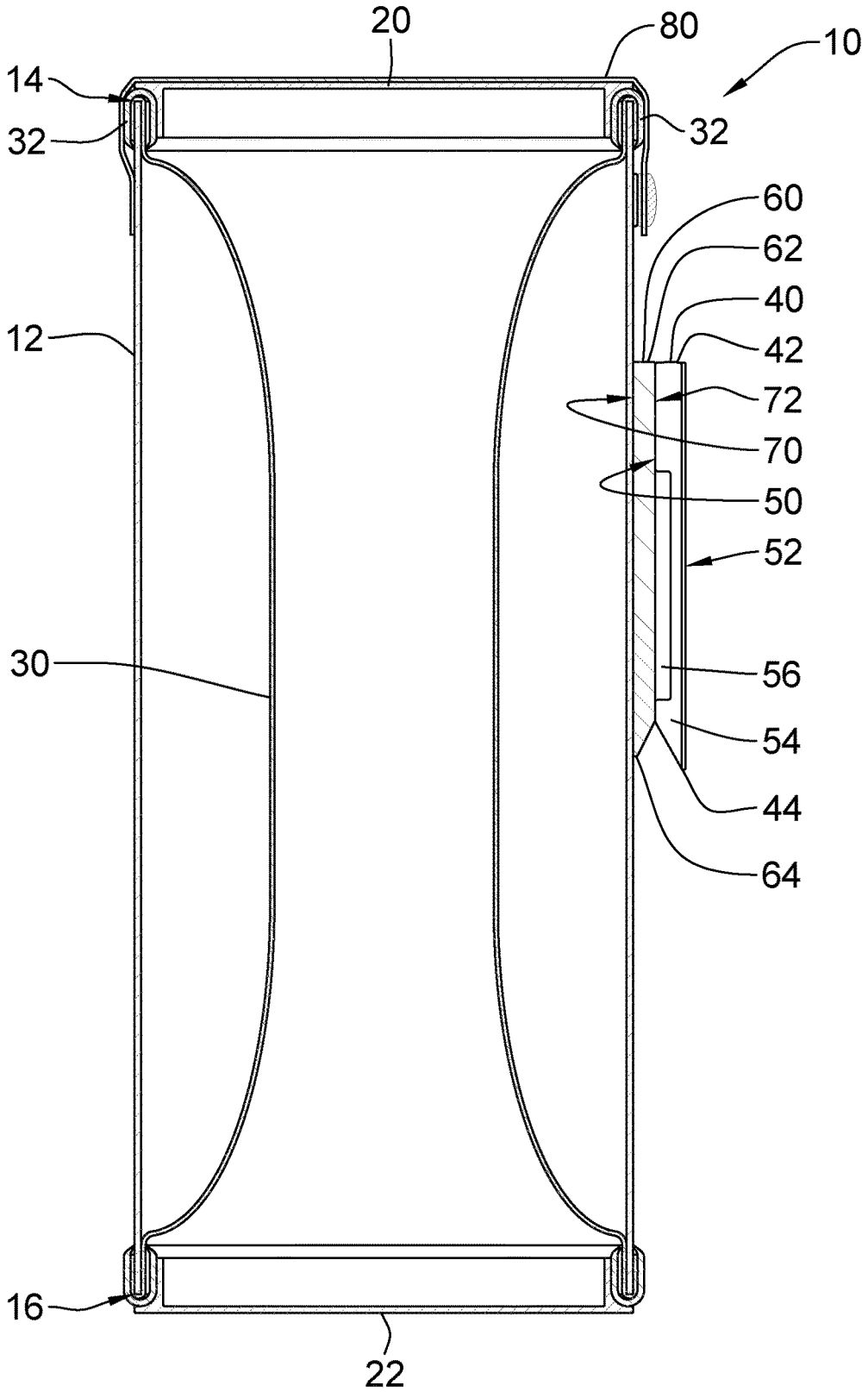
FIG. 3 is a cross-sectional view of the container taken along the line 3-3 of FIG. 2.

Referring to FIG. 1, an apparatus for carrying articles according to a first embodiment of the invention is shown generally at 10. The container 10 includes a body 12 which extends between top and bottom edges, 14 and 16, respectively, with optional top and bottom covers, 20 and 22, respectively, thereon. As illustrated in FIG. 3, an internal suspension sleeve 30 extends between the top and bottom edges, 14 and 16, as will be described in more detail below. A plurality of at least one container attachment clips 40 may be secured to the body 12 to allow for the container 10 to be selectively attached to a carrying system, such as a belt 8.

Figure 2:
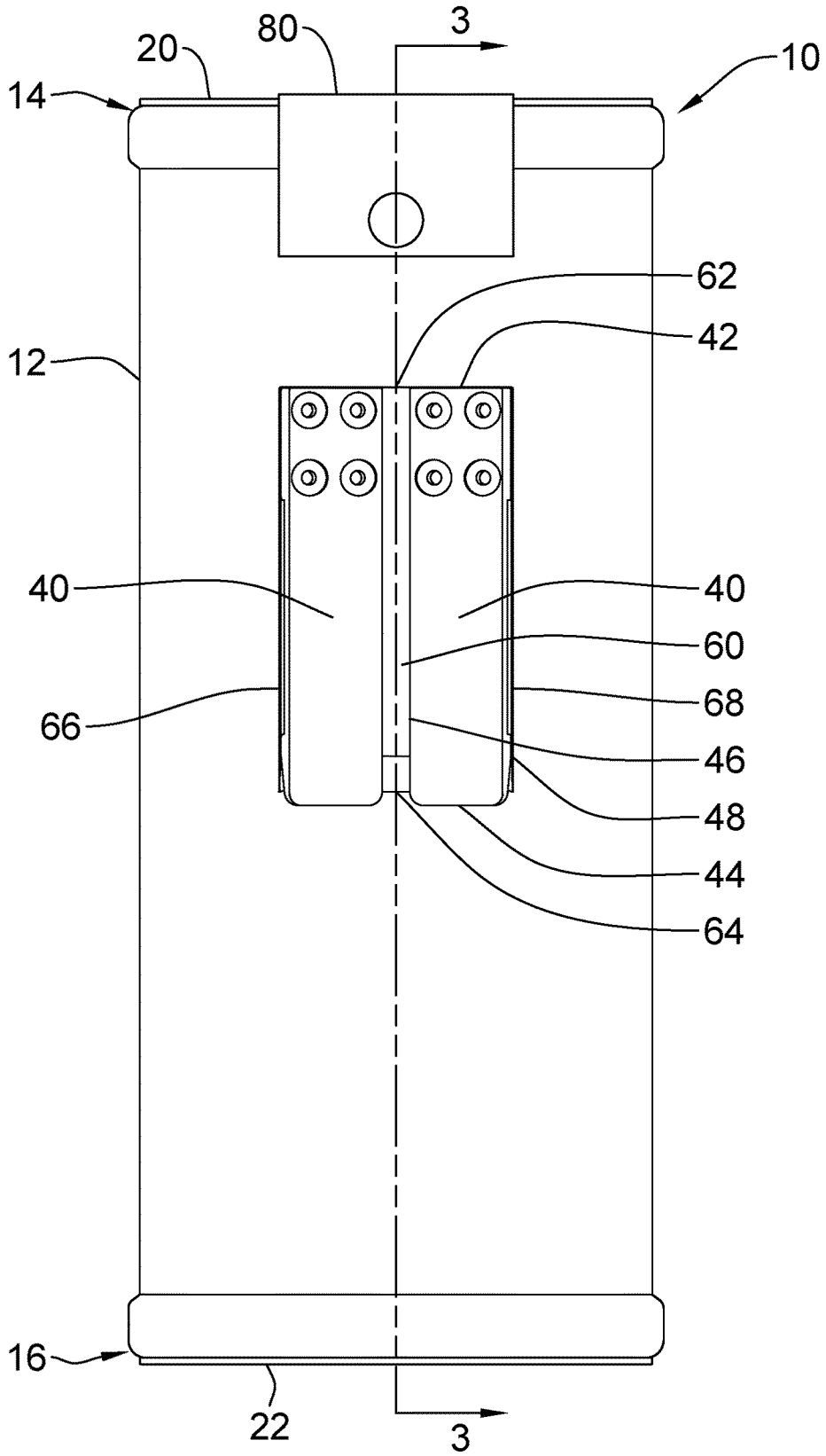
FIG. 2 is a rear view of the container of FIG. 1, with a closed cover.
Figure 4:
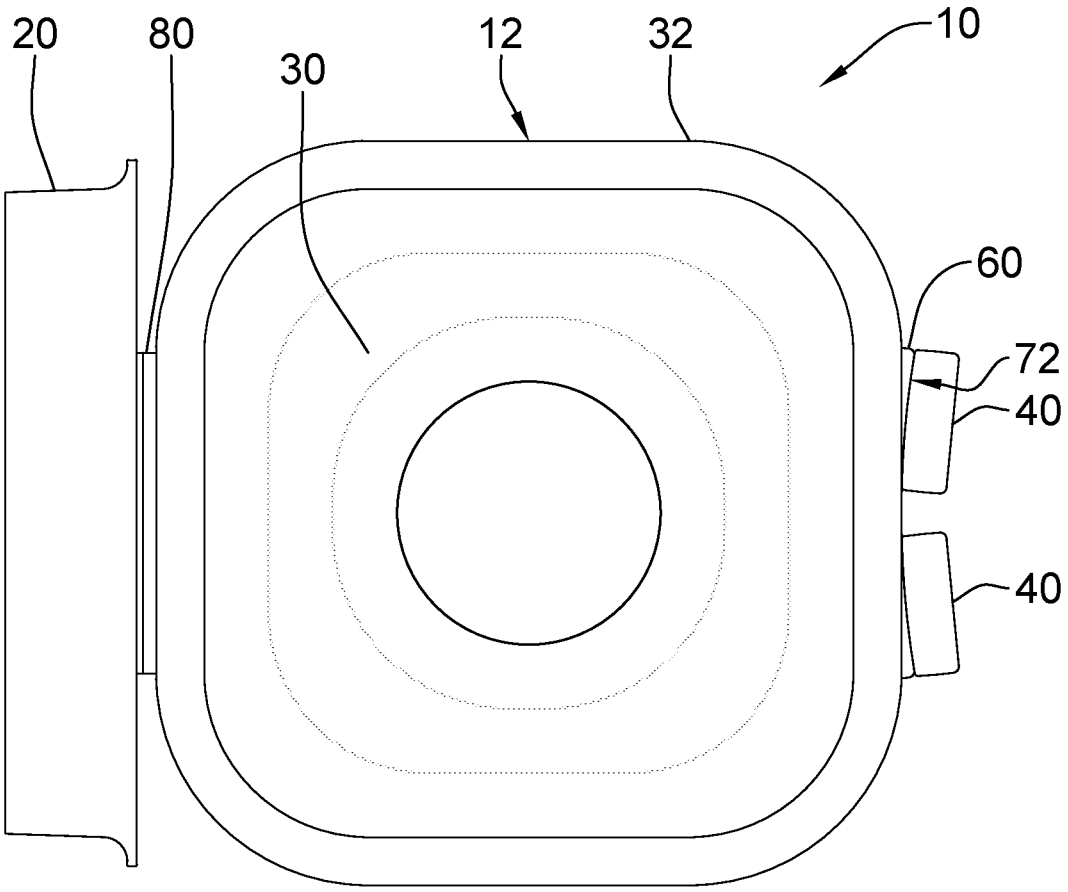
FIG. 4 is a top view of the container of FIG. 1 with an open cover.

Referring to FIGS. 2, 3 and 4, in the current embodiment of the invention, the body 12 may be formed in an essentially square shape with rounded corners, onto which a spacer block 60 is mounted with the attachment clips 40 secured thereto. The spacer block 60 and attachment clips 40 may be simultaneously secured to the body 12 by any known means, such as, by way of non-limiting example, rivets or adhesive, although it may be appreciated that other attachment methods may be useful, as well. Although the body shape is illustrated as square, it may be appreciated that other body shapes such as, by way of non-limiting example, circular, rectangular or irregular, may be useful, as well. It will be appreciated that the height of the body 12 of each container 10 may vary to accommodate variable sizes of articles therein. The body 12 may be constructed using, such as, by way of non-limiting example, a thin wall PVC extrusion, although other materials and methods of construction may be useful, as well.

The top and bottom covers, 20 and 22, match the shape profile of the body 12 and may be sized to fit within the body 12, as illustrated in FIG. 3 of the present embodiment of the invention, although it may be appreciated that it may be useful to have the top and bottom covers, 20 and 22, fit over the body 12, as well. The bottom cover 22 may be permanently secured to the body 12 at the bottom edge 16 by any known means, such as, by way of non-limiting example, rivets or adhesive. It may be appreciated that the body 12 and bottom cover 22 may be co-formed, as well. The top cover 20 is removable from the body 12, as illustrated in FIG. 4, and may be secured with a flexible mounting strap and fastener 80, as is commonly known. The top and bottom covers, 20 and 22, may be constructed using such as, by way of non-limiting example, ABS molded or vacuum formed plastics, although other materials and methods of construction may be useful, as well.

Referring to FIGS. 2 and 3, the spacer block 60 is located between the plurality of at least one attachment clips 40 and the container body 12 and extends between top and bottom edges, 62 and 64, respectively, first and second side edges, 66 and 68, respectively, with inside and outside surfaces, 70 and 72, respectively. The spacer block 60 may be constructed using such as, by way on non-limiting example, ABS injection molded plastic, although other materials and methods of construction may be useful as well. The plurality of at least one attachment clips 40 extends between top and bottom edges, 42 and 44, respectively, and between first and second side edges, 46 and 48, respectively, with inside and outside surfaces, 50 and 52, respectively, and is simultaneously secured to the spacer block 60 and the body 12, as set out above, proximate to the top edge 42. A tapered ridge 54 extends from the inside surface 50 proximate to the bottom edge 44 and engages upon the spacer block 60 such that a gap 56 is formed between the inside surface 50 of the attachment clip 40 and the spacer block 60. The tapered ridge 54 is sized and positioned such that the gap 56 may receive, and the inside surface 50 of the attachment clip 40 may engage upon a belt 8.

Turning now to FIG. 4, the outside surface 72 of the spacer block 60 may be curved such that when the attachment clips 40 are mounted on the spacer block 60, the attachment clips are angularly aligned with one another. The at least one attachment clip 40 is constructed using such as, by way of non-limiting example, injection molded nylon, although other materials and methods of construction may be useful, as well. As illustrated in FIGS. 2 and 4, the present embodiment of the invention includes two attachment clips 40, although it may be appreciated that more or less attachment clips 40 may be useful, as well.

Figure 5:
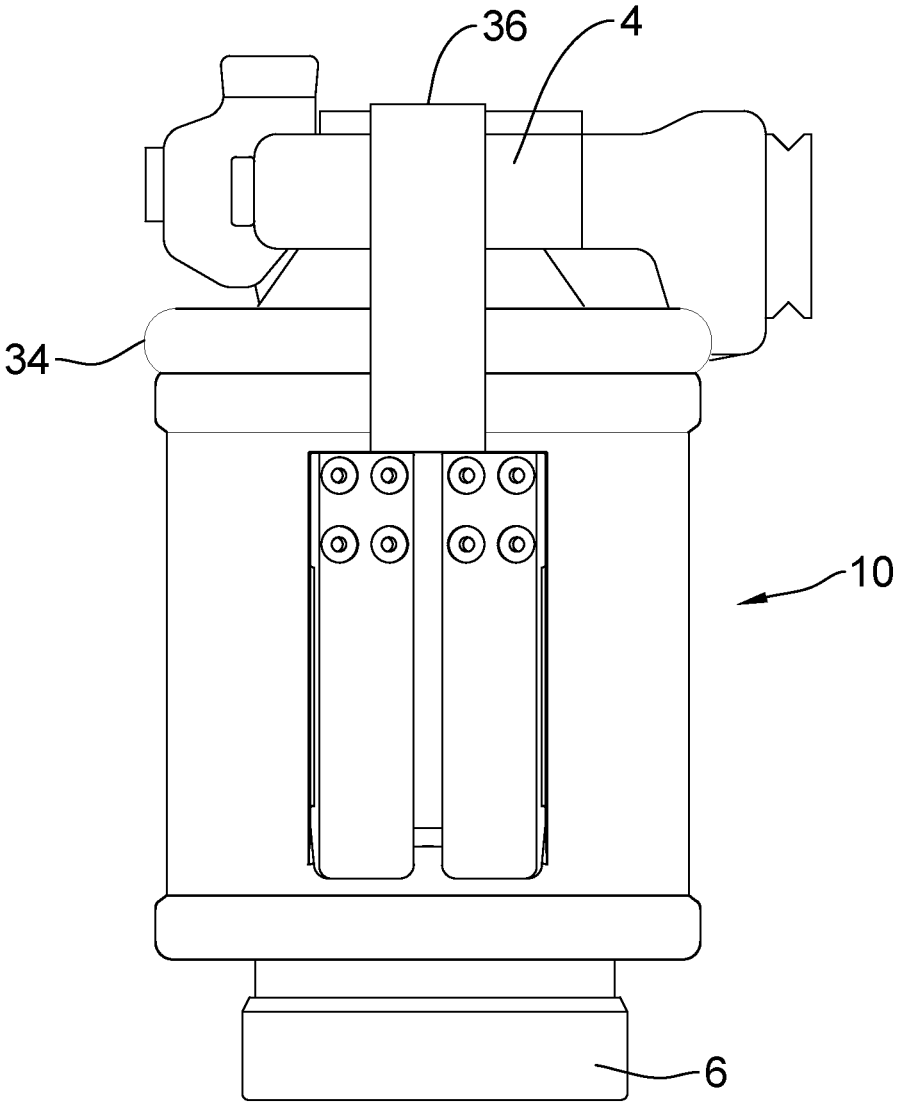
FIG. 5 is a back view of a container with an open top and bottom, with a camera body and lens therein.

Referring to FIGS. 3 and 4, the internal suspension sleeve 30 is fabricated using a flexible, stretchable material, such as, by way of non-limiting example, a 3/64 inch (1 mm) thick neoprene material with stretch Lycra nylon laminated thereon both inner and outer surfaces. Referring to FIG. 3, the internal suspension sleeve 30 is sized such that the diameter of the sleeve is smaller than the outer profile of the body 12 when in the relaxed position, with the length extending beyond the top and bottom edges, 14 and 16, of the body 12. Alternately, the internal suspension sleeve 30 may have a length that does not extend to the top and bottom edges, 14 and 16, of the body 12 when in the relaxed position, and is thus stretched to extend beyond the top and bottom edges, 14 and 16, to be secured for use, forming an hourglass shape. The ends of the internal suspension sleeve 30 are stretched over the top and bottom edges, 14 and 16, of the body 12 and secured in place by any known means, such as, by way of non-limiting example, adhesive or sewn in place with thread. Subsequent to attachment of the suspension sleeve 30 to the body 12, an edge trim molding 32, as is commonly known, may be fitted around the entire top and bottom edges, 14 and 16, of the body 12, thus encapsulating the edges of both the suspension sleeve 30 and body 12. When stretched and secured in place, the internal suspension sleeve 30 forms an hourglass shape, as illustrated in FIG. 3, which supports and centers articles therein without the need for additional support or padding. As the internal suspension sleeve 30 is flexible and stretchable, any shape of article may be contained therein, limited by the size and shape of the body 12. It may be appreciated that the container 10 may be constructed without top or bottom covers, 20 or 22. In particular, such a configuration with an open top and bottom and an elasticized internal suspension sleeve may be particularly useful for carrying a camera body 4 with attached lens 6 as illustrated in FIG. 5. It will be appreciated that additional padding around the top of such container provided by replacing the body edge trim mold with an edge trim mold having an integral padded bulb 34 may be useful as well as a snap strap 36 for securing the camera body 4 therein may also be useful.

Figure 6:
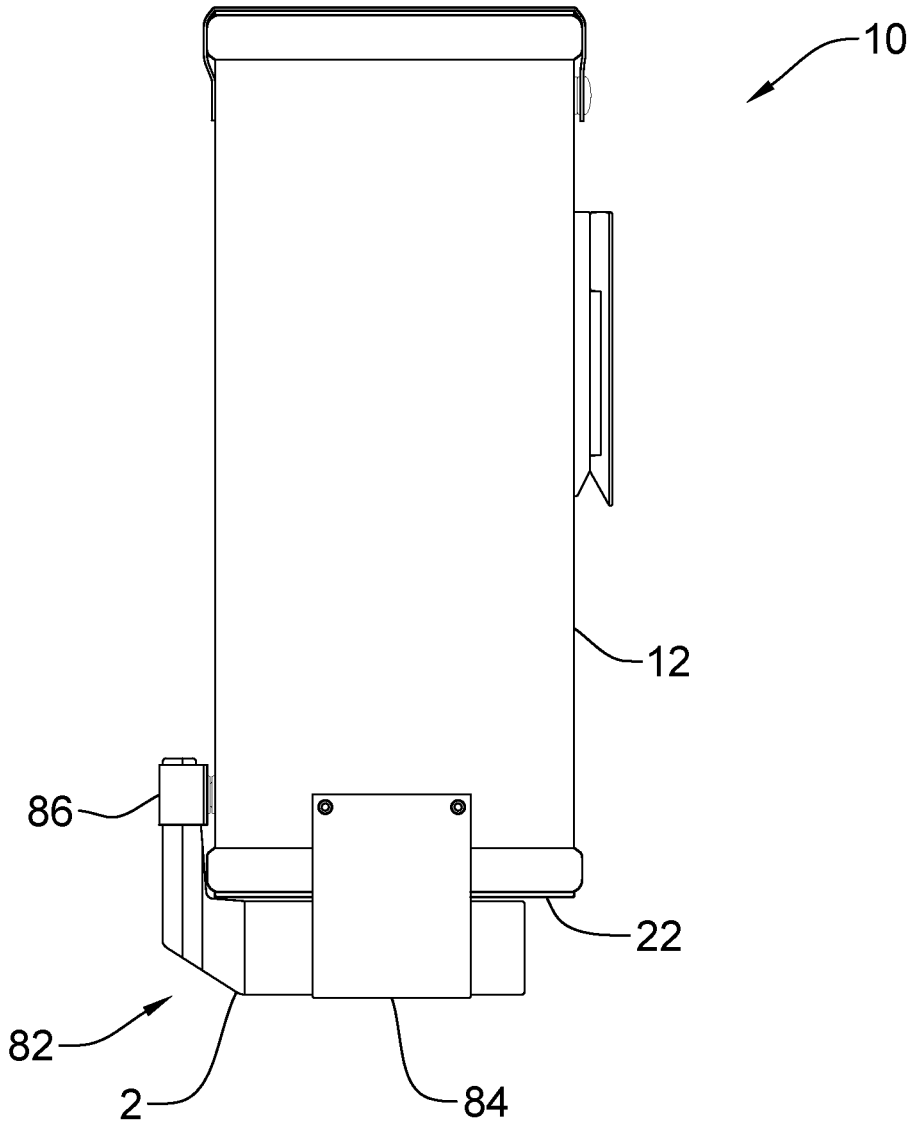
FIG. 6 is a side view of a container with an optional lens tripod bracket attachment.

Optional attachments may be added to the container 10, as illustrated by example in FIG. 6. One example of an optional attachment is a lens tripod bracket attachment assembly 82. A lens tripod bracket 2 may be secured to the bottom of a container 10 with an elasticized bottom strap 84, secured to the bottom cover 22 with, such as, by way of non-limiting example, rivets, and a removable elasticized side strap 86, fastened to the body 12 with, such as, by way of non-limiting example, a snap or hook and loop fastener. It may be appreciated that other attachment assemblies for other accessories may be useful, as well.

While specific embodiments of the invention have been described and illustrated, such embodiments should be considered illustrative of the invention only and not as limiting the invention as construed in accordance with the accompanying claims.

What is claimed is:

1. An apparatus for carrying articles comprising:

an outer shell having a shell length extending between top and bottom ends;

an attachment for securing said outer shell to a support;

an elastic tubular inner sleeve having a continuous circumferential surface with a smaller diameter than said outer shell and a sleeve length less than said shell length; and wherein said inner sleeve is longitudinally stretched to extend at least between said top and bottom ends of said outer shell and radially stretched at said top and bottom ends to form an hourglass shape narrowed at a middle portion thereof to a stretched middle diameter less than an unstretched middle diameter at an unstretched condition inside said outer shell.

2. The apparatus of claim 1 wherein said outer shell has a square tubular shape with rounded corners.

3. The apparatus of claim 1 wherein said attachment comprises a selectably securable clip.

4. The apparatus of claim 1 wherein said elastic tubular inner sleeve is fabricated using neoprene material with Lycra nylon laminated thereon.

5. The apparatus of claim 1 wherein said elastic tubular inner sleeve is longitudinally stretched to extend beyond said top and bottom ends of said outer shell.

6. The apparatus of claim 5 wherein said elastic tubular inner sleeve is folded over said top and bottom ends of said outer shell to enclose said top and bottom ends of said outer shell.

7. The apparatus of claim 6 wherein said elastic tubular inner sleeve is secured to said outer shell at said top and bottom ends of said outer shell with an attachment method selected from a group consisting of sewing and adhesive.

8. The apparatus of claim 6 wherein said elastic tubular inner sleeve is secured to said outer shell at said top and bottom ends of said outer shell with edge trim moldings.

9. The apparatus of claim 1 further comprising at least one lid.

10. The apparatus of claim 9 wherein said at least one lid is selectably securable to said top or bottom end of said outer shell.

11. The apparatus of claim 9 wherein said at least one lid is secured to said bottom end of said outer shell.

* * * * *